US010428476B2

(12) United States Patent
Barzilai

(10) Patent No.: US 10,428,476 B2
(45) Date of Patent: Oct. 1, 2019

(54) DEVICE FOR NON-IMPACT STOPPING OF VEHICLES

(71) Applicant: Yoav Barzilai, Ashkelon (IL)

(72) Inventor: Yoav Barzilai, Ashkelon (IL)

( * ) Notice: Subject to any disclaimer, the term of this patent is extended or adjusted under 35 U.S.C. 154(b) by 0 days.

(21) Appl. No.: 16/075,654

(22) PCT Filed: Feb. 19, 2017

(86) PCT No.: PCT/IL2017/050210
§ 371 (c)(1),
(2) Date: Aug. 5, 2018

(87) PCT Pub. No.: WO2017/141254
PCT Pub. Date: Aug. 24, 2017

(65) Prior Publication Data

US 2019/0085519 A1 Mar. 21, 2019

Related U.S. Application Data

(60) Provisional application No. 62/296,617, filed on Feb. 18, 2016.

(51) Int. Cl.
*E01F 13/12* (2006.01)

(52) U.S. Cl.
CPC ..... *E01F 13/12* (2013.01)

(58) Field of Classification Search
CPC ..... E01F 13/00; E01F 13/12; E01F 15/00
See application file for complete search history.

(56) References Cited

U.S. PATENT DOCUMENTS

| | | | | |
|---|---|---|---|---|
| 5,310,277 | A | 5/1994 | Uotila | |
| 5,775,832 | A * | 7/1998 | Kilgrow | E01F 13/12 404/6 |
| 6,220,781 | B1 * | 4/2001 | Miller | E01F 13/12 404/6 |
| 6,409,420 | B1 * | 6/2002 | Horton | E01F 13/12 404/6 |
| 8,657,526 | B2 | 2/2014 | Withers et al. | |
| 10,030,343 | B1 * | 7/2018 | Spencer | B60R 25/09 |
| 2002/0085880 | A1 | 7/2002 | Schneider et al. | |
| 2006/0140715 | A1 * | 6/2006 | Lyddon | E01F 13/12 404/6 |
| 2008/0060271 | A1 * | 3/2008 | Beniamin | E01F 13/12 49/34 |
| 2009/0317185 | A1 | 12/2009 | Drew et al. | |
| 2010/0133411 | A1 * | 6/2010 | Gelfand | E01F 13/12 248/500 |

(Continued)

FOREIGN PATENT DOCUMENTS

WO 1991002563 3/1991

*Primary Examiner* — Abigail A Risic

(57) ABSTRACT

A device (10) for non-impact stopping of a wheeled vehicle includes a net structure formed from flexible elements (2) extending in a first direction interconnected with flexible elements (3) extending in a second direction, non-parallel to the first direction. Tire-penetrating elements (12) are mechanically linked to the net structure. At least part of the net structure is formed from tear-webbing deployed so as to irreversibly absorb energy applied to deform the net structure. Most preferably, at least part of each of the flexible elements (2, 3) extending in one or both of the first and second directions is formed from tear-webbing.

12 Claims, 5 Drawing Sheets

(56) References Cited

U.S. PATENT DOCUMENTS

| | | | | |
|---|---|---|---|---|
| 2010/0284739 | A1* | 11/2010 | Allsopp | E01F 13/12 404/6 |
| 2011/0097147 | A1* | 4/2011 | Castro | E01F 13/12 404/6 |
| 2012/0251237 | A1* | 10/2012 | Dandy | E01F 13/12 404/6 |
| 2014/0119825 | A1* | 5/2014 | Castro | E01F 13/12 404/6 |
| 2017/0130411 | A1* | 5/2017 | Price | E01F 13/12 |
| 2018/0298571 | A1* | 10/2018 | Edgar | E01F 13/12 |

* cited by examiner

DEVICE FOR NON-IMPACT STOPPING OF VEHICLES

FIELD AND BACKGROUND OF THE INVENTION

The present invention relates to a device for safely stopping a vehicle in security, law enforcement and other scenarios.

It is known to employ net-like devices which wrap around vehicle wheels in order to stop vehicles. Such devices tend to lead to abrupt locking of the wheels, which may result in skidding and loss of control of the vehicle.

SUMMARY OF THE INVENTION

The present invention is a device for non-impact stopping of a wheeled vehicle.

According to the teachings of the present invention there is provided, a device for non-impact stopping of a wheeled vehicle, the device comprising: (a) a net structure formed from a first plurality of flexible elements extending in a first direction interconnected with a second plurality of flexible elements extending in a second direction, non-parallel to the first direction; and (b) a plurality of tire-penetrating elements mechanically linked to the net structure, wherein at least part of the net structure is formed from tear-webbing deployed so as to irreversibly absorb energy applied to deform the net structure.

According to a further feature of an embodiment of the present invention, at least part of each of the flexible elements extending in the first direction is formed from the tear-webbing.

According to a further feature of an embodiment of the present invention, at least part of each of the flexible elements extending in the second direction is formed from the tear-webbing.

According to a further feature of an embodiment of the present invention, each of the flexible elements extending in the first direction is formed with a plurality of eyelets through which pass the flexible elements of the second plurality of flexible elements, and most preferably, each of the flexible elements extending in the second direction is also formed with a plurality of eyelets through which pass the flexible elements of the first plurality of flexible elements, a portion of the flexible elements between adjacent of the eyelets being formed from a pair of webbing elements interconnected by tearable connections so as to form part of the tear-webbing.

According to a further feature of an embodiment of the present invention, the plurality of tire-penetrating elements are mechanically linked to the net structure via a corresponding set of parallel straps extending from one edge of the net structure, the straps being individually liftable so as to wrap around a wheel of an incoming vehicle.

According to a further feature of an embodiment of the present invention, each of the tire-penetrating elements is implemented as a spike-plate comprising a base and at least one spike projecting from the base.

According to a further feature of an embodiment of the present invention, the at least one spike is a barbed spike configured to become lodged in material of a tire.

According to a further feature of an embodiment of the present invention, the at least one spike is configured to provide a venting channel for venting air pressure from within a tire.

According to a further feature of an embodiment of the present invention, there is also provided a positioning strip, the plurality of spike-plates being releasably attached to the positioning strip in spaced-apart relation so as to facilitate deployment of the plurality of spike-plates and the straps.

According to a further feature of an embodiment of the present invention, the net structure is provided with a plurality of lateral connectors, the lateral connectors being configured for interconnecting the net structure with another similar net structure to form an extended-width net structure.

According to a further feature of an embodiment of the present invention, each of the lateral connectors includes an energy absorbing tether.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
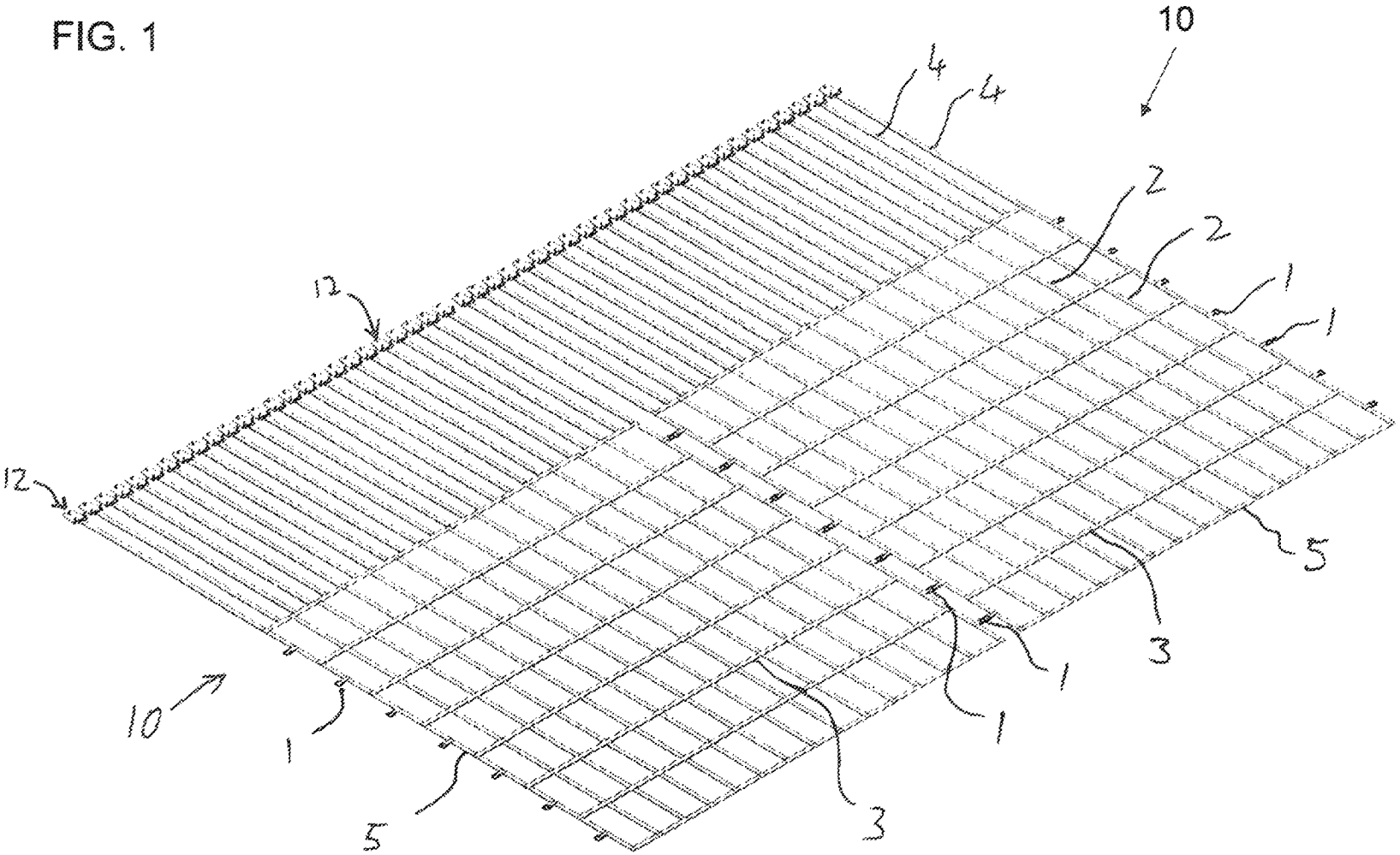
FIG. 1 is an isometric view of a device for non-impact stopping of a wheeled vehicle, constructed and operative according to an embodiment of the present invention.
Figure 2:
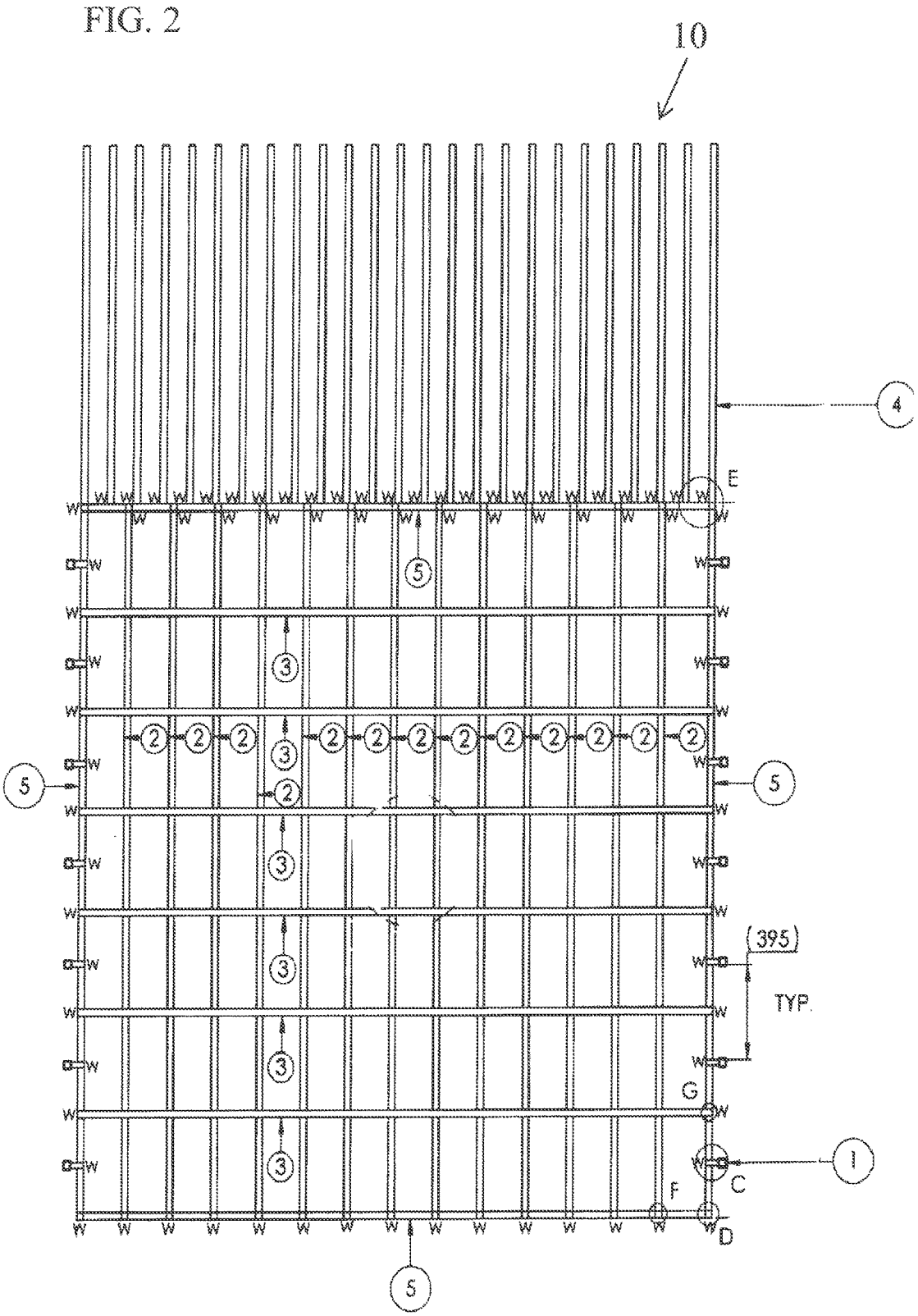
FIG. 2 is a plan view of a net structure from the device of FIG. 1.

The present invention is a device for non-impact stopping of a wheeled vehicle.

The principles and operation of devices according to the present invention may be better understood with reference to the drawings and the accompanying description.

In general terms, as illustrated in the accompanying drawings, the device employs a net structure which becomes wrapped around the wheels of the vehicle as it advances across the device, thereby disabling the vehicle and bringing the vehicle to as stop. In order to avoid abrupt stopping of the wheels which might lead to immediate skidding and loss of control, and to stop the vehicle in a controlled manner, certain preferred implementations of the present invention employ energy absorbing elements integrated as part of the structure of the net.

Energy absorbing elements are well known in the context of Working at Height, where energy absorbing lanyards are employed to suspend safety harnesses to prevent sudden impact to the body as a safety line pulls tight during a fall. The predominant technology used is tear webbing, described in patents dating back to U.S. Pat. No. 3,978,894 (1976), where a connection between two strips of webbing progressively tears apart. The present invention employs energy absorbing elements, such as tear webbing, as part of the net itself and/or connecting between adjacent sections of net.

Thus, the present invention provides a device, generally designated 10, for non-impact stopping of a wheeled vehicle, the device including a net structure formed from a first plurality of flexible elements 2 extending in a first direction interconnected with a second plurality of flexible elements 3 extending in a second direction, non-parallel to said first direction. A plurality of tire-penetrating elements 12 are mechanically linked to net structure 10. At least part of net structure 10 is formed from tear-webbing deployed so as to irreversibly absorb energy applied to deform said net structure.

The term "tear-webbing" is used herein in the description and claims to refer to any energy-absorbing structure which absorbs energy through successively breaking or otherwise irreversibly releasing interconnections between two lengths of material that are initially interconnected. The two lengths of material are referred to loosely as "webbing" to conform to the accepted "tear-webbing" terminology, but without in any way limiting the structure of the elements, which may be flat webbing, tubular webbing, rope, cable or any other material suitable for forming a net, based on natural or synthetic fibers or filaments. The tearable connections are typically implemented using fibers similar to that used in conventional tear-webbing, as is known in the art of energy absorbing lanyards. As in all tear-webbing applications, the energy absorption is gradual and irreversible, resulting in progressive slowing of motion in a controlled manner.

Figure 4:
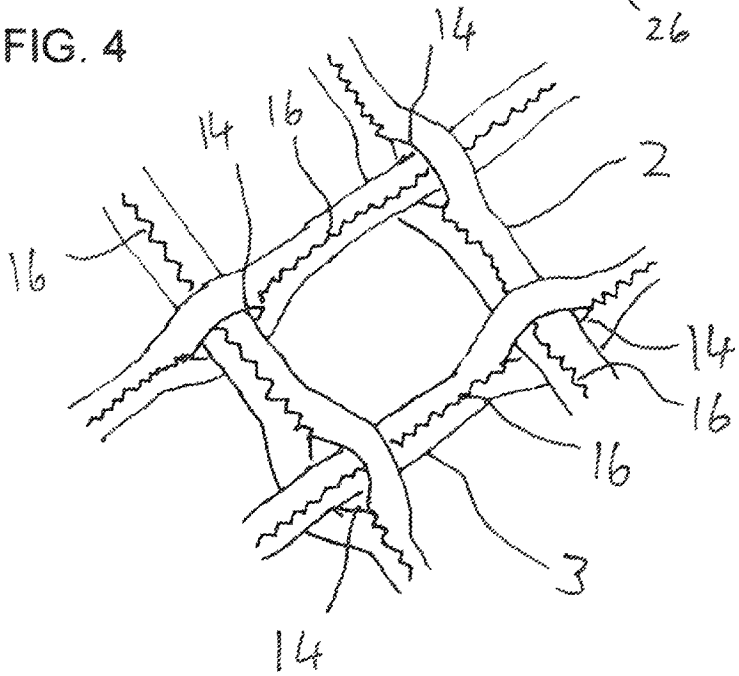
FIG. 4 is an enlarged schematic view of a number of intersections between elements making up the net structure of FIG. 1.

In one particularly preferred implementation illustrated herein, the net elements extending in at least one direction, and most preferably in both directions, are implemented with tearable seams extending along their lengths. As best shown schematically in the net structure detail of FIG. 4, some or all crossings between the net elements are advantageously implemented as an "eye" or "eyelet" 14 in one of the elements through which the other passes. Where both elements 2 and 3 are implemented using tear-webbing, the eyelets may advantageously be implemented in alternating sequence to provide a weave-like effect as shown. Between these eyelets, all or part of the net element is formed from a two-part element interconnected by one or more tearable seam 16. As a result of this structure, large forces applied to the net in any direction tend to force one or other of the net elements through the tearable seams of the other transverse elements, thereby progressively absorbing more and more energy in a controlled and non-abrupt manner.

The energy absorbing structure of the net described herein typically does not significantly change its dimensions during operation. Optionally, some of the elements within the net and/or elements connecting between adjacent sections of net may be implemented as energy absorbing elements which extend during operation, in a manner similar to conventional energy absorbing lanyards. Optionally, an outer perimeter S of the net may be formed from a conventional cable, of similar or heavier gauge than the internal elements of the net, to provide a stable framework for the structure.

The device of the present invention is typically directional in deployment due to the deployment of straps and spike plates, described below, defining an expected direction of travel of the vehicle to be stopped. The net of the present invention may be deployed with net elements aligned parallel and perpendicular to the expected direction of travel, as shown here. In alternative implementations, the net elements may be deployed at ±45° to the expected direction of travel, or any other angles thereto.

In order to ensure reliably lifting of the net to wind itself around the wheels of a vehicle, the device preferably includes a set of elongated straps (or "strips") 4, independently liftable, which extend forwards towards the direction from a vehicle is expected to arrive. Each strap 4 terminates at a tire-penetrating element, here implemented as a spike plate 12 or other spike arrangement for attaching itself to a tire. The spacing between straps 4 and spike arrangements is such that the width of the narrowest tire likely to be encountered will cross at least one of the spike arrangements and strips. For a range of common implementations, a lateral spacing of no more than 20 cm, and typically in the range of 10-15 cm, has been found to be particularly effective.

Figure 7:
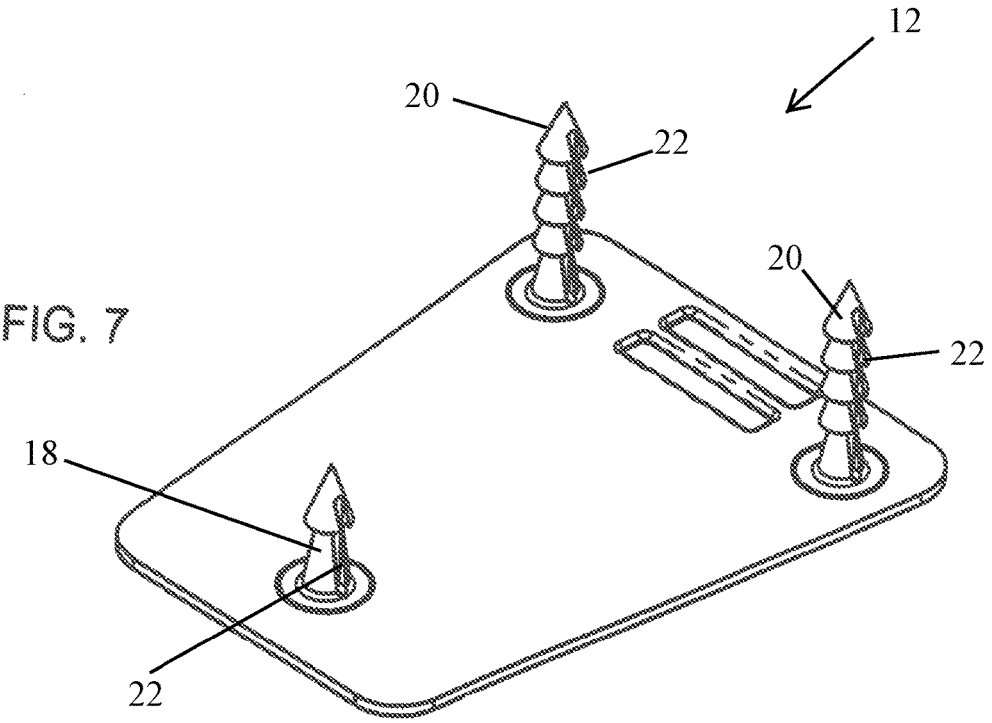
FIG. 7 is an enlarged isometric view of a first implementation of a spike plate from the device of FIG. 1.
Figure 8:
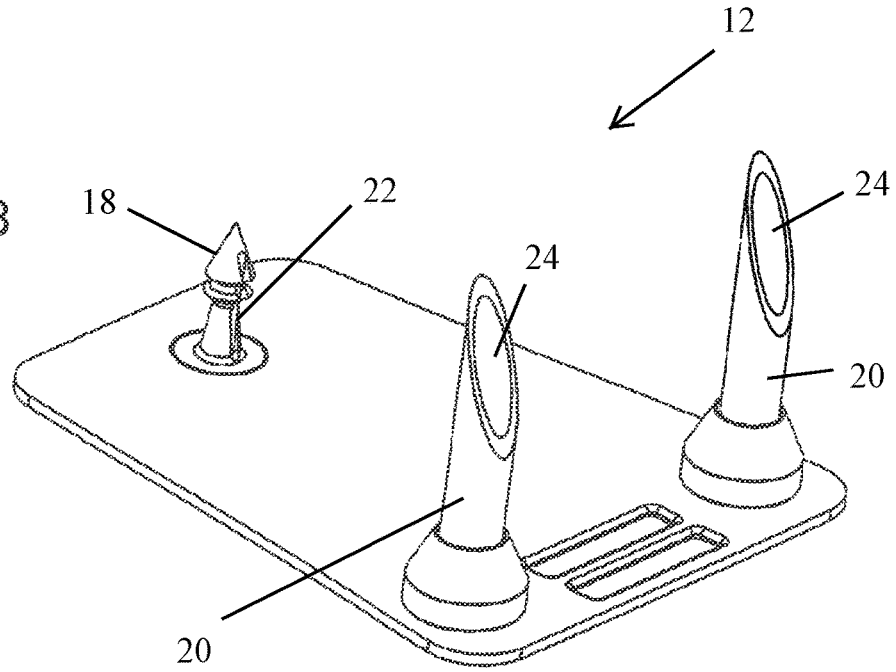
FIG. 8 is an enlarged isometric view of a second implementation of a spike plate from the device of FIG. 1.

Two exemplary implementations of spike plate 12 for connection to the end of each strap 4 are illustrated in FIGS. 7 and 8. At least one of the spikes is preferably a barbed structure which tends to penetrate into the material of the tire and retain itself in engagement with the tire. Each strap 4 has at least one associated spike, and an arrangement of two, or more preferably three, spikes projecting from a common base plate is advantageous. A relatively short first leading spike 18 followed by two larger spikes 20 is particularly preferred. One or more of the spikes is preferably configured to efficiently vent air from a pneumatic tire so as to flatten the tire, either by provision of a lateral channel 22 or via a central hollow 24. The base plate and the spikes can be formed from any suitable structural material, typically of metal. Optionally, different materials may be used for the spikes and for the base plate.

It is particularly advantageous to employ the aforementioned arrangement of straps 4 to be encountered before the vehicle reaches the net, since the straps are lightweight and are reliably lifted by the spike arrangements individually so as to wrap around the wheel with little resistance. A strap of this sort wrapped at least partially around a wheel provides a highly effective anchor for drawing the net to wrap around the wheel, since tension applied to the strap only tightens it more around the wheel. Most preferably, the straps are sufficiently long to wrap themselves at least about 1 revolution around the wheel of the type of vehicle to be stopped. For certain cases, a strap length of at least about 1 meter, and more preferably at least about 1.5 meters, has been found highly effective.

Figure 3:
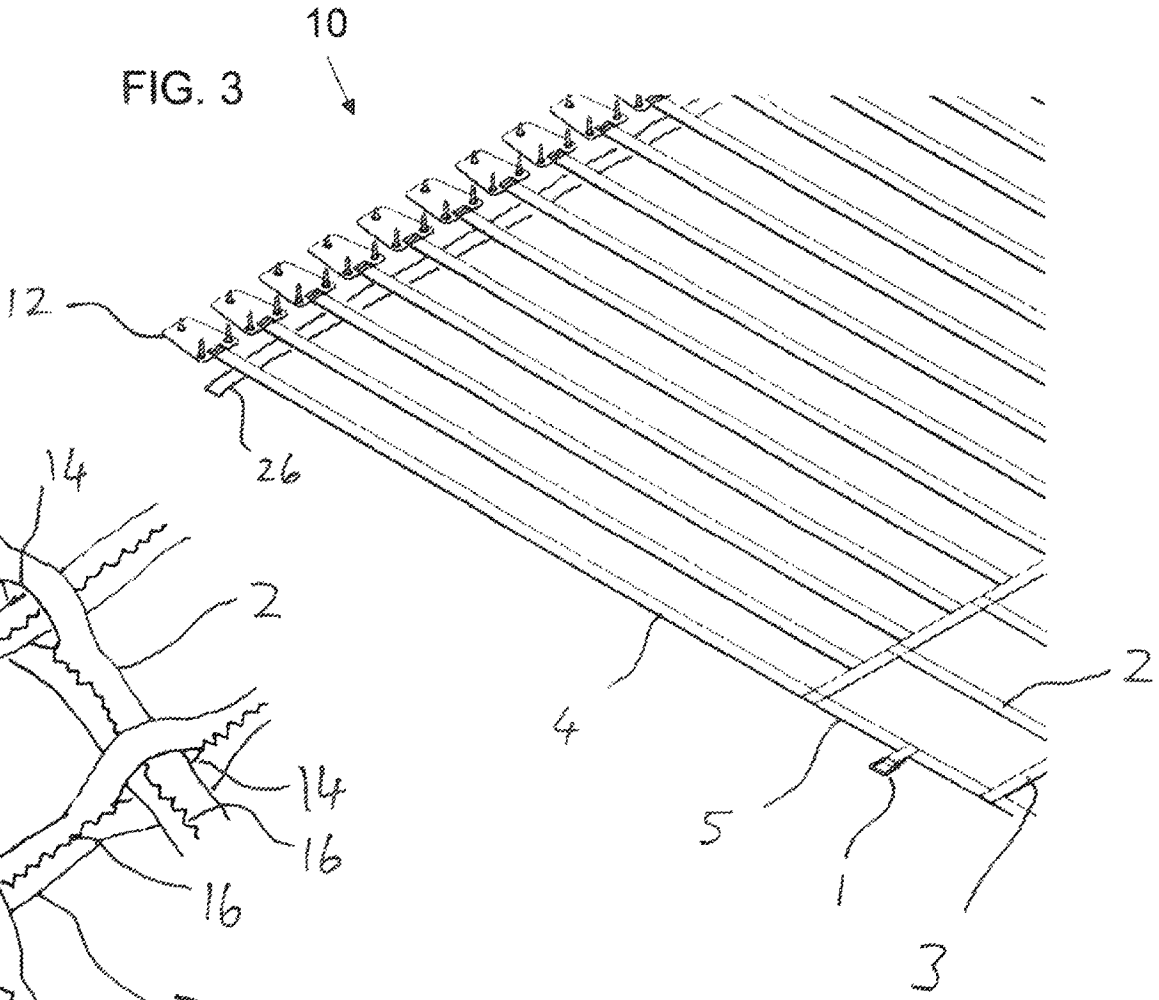
FIG. 3 is an enlarged view of a region of FIG. 1 showing an array of parallel straps and spike plates.

Although straps 4 are lifted individually, independent of the neighboring straps, when operating to capture a wheel, it may be advantageous to provide a light retention arrangement, such as one or more crossways strip 26 of VELCRO® or any other form of easily-detachable or breakable retention, as illustrated in FIG. 3, to facilitate and maintain correct positioning of the straps and spike arrangements. The crossways strip 26 may engage either the spike plates 12 or a part of straps 4.

The entire device 10 is preferably implemented as a modular unit of, for example, 3 meter width, which can be attached in side-by-side relation with one or more additional similar unit 10 to provide coverage for multiple lanes. FIG. 1 illustrates two units 10 interconnected. In one exemplary embodiment, the length of the net is also roughly 3 meters, while the straps extend forwards from the net an additional 1.5 meters. A device of these dimensions has been found highly effective for stopping cars and small trucks travelling even at high speeds without loss of control. Clearly, the dimensions and other parameters of the design can be scaled up if required for the requirements of any given application.

Figure 6:
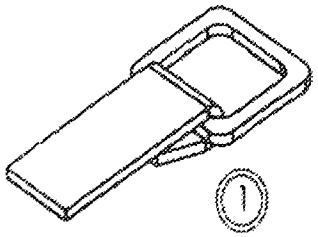
FIG. 6 is a schematic enlarged isometric view of a connector structure from FIG. 5.
Figure 5:
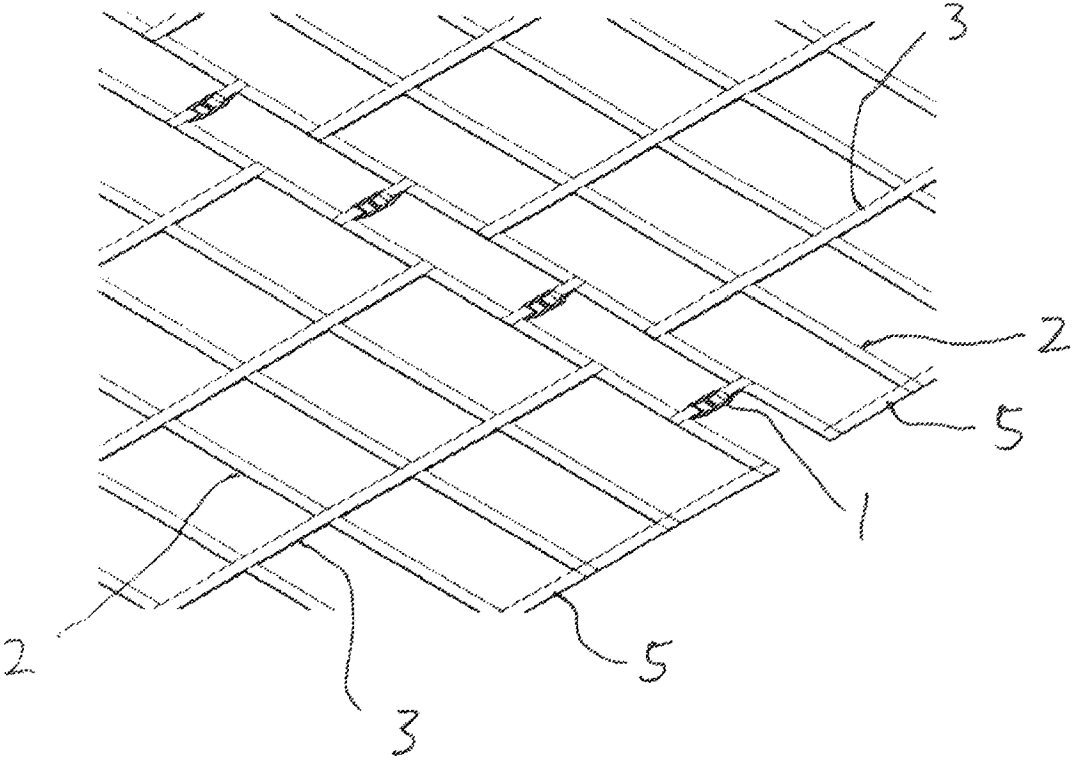
FIG. 5 is an enlarged view of a region of FIG. 1 showing an arrangement for interconnecting two adjacent net structures.

Interconnection of adjacent devices is preferably achieved via a number of lateral connectors 1 provided along the sides of the net structure to connect it with one or more additional similar net structure to form an extended-width net structure, as illustrated in FIGS. 1, 5 and 6. Most preferably, each of the lateral connectors includes an energy absorbing tether, typically implemented using an element similar to those employed in energy-absorbing lanyards, thereby providing supplementary energy absorbing properties.

To the extent that the appended claims have been drafted without multiple dependencies, this has been done only to accommodate formal requirements in jurisdictions which do not allow such multiple dependencies. It should be noted that all possible combinations of features which would be implied by rendering the claims multiply dependent are explicitly envisaged and should be considered part of the invention.

It will be appreciated that the above descriptions are intended only to serve as examples, and that many other embodiments are possible within the scope of the present invention as defined in the appended claims.

What is claimed is:

1. A device for non-impact stopping of a wheeled vehicle, the device comprising:

(a) a net structure formed from a first plurality of flexible elements extending in a first direction interconnected with a second plurality of flexible elements extending in a second direction, non-parallel to said first direction;

(b) a plurality of tire-penetrating elements mechanically linked to a leading edge of said net structure;

(c) a plurality of irreversible energy absorbing elements integrated into the net structure in two non parallel directions, so as to irreversibly absorb energy applied to deform said net structure.

2. The device of claim 1, wherein at least part of of said flexible elements extending in said first direction is formed from said irreversible energy absorbing elements.

3. The device of claim 2, wherein each of said flexible elements extending in said first direction is formed with a plurality of eyelets through which pass said flexible elements of said second plurality of flexible elements, a portion of said flexible elements between adjacent of said eyelets being formed from a pair of webbing elements interconnected by said irreversible energy absorbing elements.

4. The device of claim 2, wherein at least part of each of said flexible elements extending in said second direction is formed from said irreversible energy absorbing elements.

5. The device of claim 4, wherein each of said flexible elements extending in said first direction is formed with a plurality of eyelets through which pass said flexible elements of said second plurality of flexible elements, and wherein each of said flexible elements extending in said second direction is formed with a plurality of eyelets through which pass said flexible elements of said first plurality of flexible elements, a portion of said flexible elements between adjacent of said eyelets being formed from a pair of webbing elements interconnected by said irreversible energy absorbing elements.

6. The device of claim 1, further comprising:

a set of parallel straps extending forward from said leading edge of said net structure and spaced apart by a lateral spacing of between 10 to 15 cm between adjacent straps and wherein said plurality of tire-penetrating elements are mechanically linked to said net structure via said set of parallel straps, each strap said set of parallel straps being individually liftable so as to wrap around a wheel of an incoming vehicle.

7. The device of claim 6, wherein each of said tire-penetrating elements is implemented as a spike-plate comprising a base and at least one spike projecting from said base.

8. The device of claim 7, wherein said at least one spike is a barbed spike configured to become lodged in material of a tire.

9. The device of claim 7, wherein said at least one spike is configured to provide a venting channel for venting air pressure from within a tire.

10. The device of claim 7, further comprising a positioning strip, and wherein each said plurality of spike-plate is releasably attached to said positioning strip preserving said 10 to 15 cm spaced-apart relation of said straps so as to facilitate deployment of each said spike-plate and said straps.

11. The device of claim 1, further comprising:

a plurality of lateral connectors attached to each lateral edge of said net structure, said lateral connectors being configured for interconnecting said net structure with another similar net structure to form an extended-width net structure.

12. The device of claim 11, wherein each of said lateral connectors includes an irreversible energy absorbing element.

* * * * *